US008579654B2

(12) United States Patent
Chen et al.

(10) Patent No.: US 8,579,654 B2
(45) Date of Patent: Nov. 12, 2013

(54) CONNECTOR FOR FLEXIBLE PRINTED CIRCUIT

(75) Inventors: Ming-Yue Chen, New Taipei (TW); Ke-Hao Chen, New Taipei (TW); Ming-Lun Szu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/481,948

(22) Filed: May 28, 2012

(65) Prior Publication Data

US 2013/0078845 A1 Mar. 28, 2013

(51) Int. Cl.
*H01R 12/24* (2006.01)

(52) U.S. Cl.
USPC ..... 439/495; 439/267

(58) Field of Classification Search
USPC ..... 439/495, 267, 260, 67
See application file for complete search history.

(56) References Cited

U.S. PATENT DOCUMENTS

| | | | | |
|---|---|---|---|---|
| 6,837,740 | B2 | 1/2005 | Kunishi et al. | |
| 6,893,288 | B2 | 5/2005 | Tsunematsu | |
| 7,261,589 | B2 | 8/2007 | Gillespie et al. | |
| 7,413,469 | B2 * | 8/2008 | Norris et al. | 439/495 |
| 7,422,472 | B2 * | 9/2008 | Hashiguchi et al. | 439/495 |
| 8,241,057 | B2 * | 8/2012 | Lee | 439/495 |
| 8,298,001 | B2 * | 10/2012 | Ashibu et al. | 439/495 |

* cited by examiner

*Primary Examiner* — Hien Vu
(74) *Attorney, Agent, or Firm* — Wei Te Chung; Ming Chieh Chang

(57) ABSTRACT

An electrical connector for connecting a flat circuit includes an insulating housing defining an insertion slot for receiving the flat circuit, a plurality of terminals arranged in the housing in parallel relationship, a shielding shell surrounding the insulating housing and an actuator. The terminals have contacting projections extending into the insertion slot. The shell provides a plurality of spaced spring fingers extending into the inserting slot and establishes a receiving path between the contacting projections and the pivot beams. The actuator is mounted on the electrical connector for movement between an open position lifting up the spring fingers of the shielding shell and allowing insertion of the flat circuit into the inserting slot and a closed position allowing the pivot beam restore and pressing against the flat circuit toward the contacting projections.

11 Claims, 7 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a flat circuit.

2. Description of Related Art

A conventional FPC connector generally includes a plurality of terminals each comprising a contact beam provided with a contact portion adapted for contacting an FPC and a pivot beam extending substantially parallel to and opposed to the contact beam, a housing adapted for holding the terminals and comprising opposite lower and upper walls defining a cavity therebetween wherein the lower wall protruding forwardly beyond the upper wall along a horizontal direction, and a pivoting actuator pivotably assembled on free ends of the pivot beams. The terminals are arranged in the housing in a side-by-side fashion, and each terminal has the contact beam thereof fixed in the lower wall of the housing and has the pivot beam thereof partly fixed in the upper wall of the housing, that is, the rear section of the pivot beam fixed in the upper wall and the front section of the pivot beam projected beyond the upper wall as a cantilever with no support. The front section of the pivot beam is provided with a concave portion for engaging with the actuator. The actuator is provided with cam portions disposed between every two adjacent pivot beams and shaft portions located between and joining every two adjacent cam portions. The shaft portions are respectively pivotably received in the concave portions of the pivot beams. Via engagement of the shaft portions of the actuator and the pivot beams of the terminals, the actuator is pivotable between an open position where an FPC can be inserted into the housing with zero-insertion-force and a closed position where the FPC is urged by the cam portions so as to connect with the contact portions of the contact beams. Such kind of FPC connectors can be found in U.S. Pat. Nos. 6,893,288 and 7,261,589.

However, high-frequent and fine profile is a tendency of electrical connectors, said connectors might be fall to meet that tendency.

SUMMARY OF THE INVENTION

An object of the present invention is to provide a new electrical connector in which crosstalk are reduced and pivot beams are strengthened.

In order to achieve above-mentioned object, an electrical connector for connecting a flat circuit, comprises an insulating housing defining an insertion slot for receiving the flat circuit, a plurality of terminals arranged in the housing in parallel relationship, a shielding shell surrounding the insulating housing and an actuator. The terminals have contacting projections extending into the insertion slot. The shell provides a plurality of spaced spring fingers extending into the inserting slot and establishes a receiving path between the contacting projections and the pivot beams. The actuator is mounted on the electrical connector for movement between an open position lifting up the spring fingers of the shielding shell and allowing insertion of the flat circuit into the inserting slot and a closed position allowing the pivot beam restore and pressing against the flat circuit toward the contacting projections.

Other objects, advantages and novel features of the present invention will become more apparent from the following detailed description of the present embodiment when taken in conjunction with the accompanying drawings.

DETAILED DESCRIPTION OF THE INVENTION

The present invention will be discussed hereafter in detail in terms of the embodiments of the present invention. However, any well-known structure or feature is not shown in detail in order to avoid unnecessary obscurity of the present invention.

Figure 1:
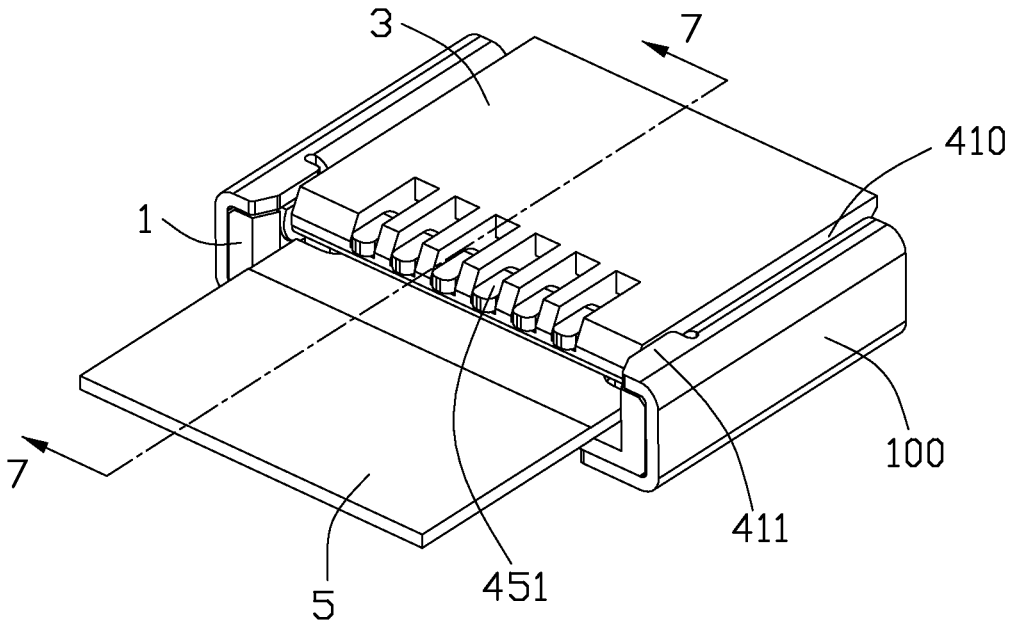
FIG. 1 is an assembled perspective view of an electrical connector in accordance with a preferred embodiment of the present invention in a close position.
Figure 2:
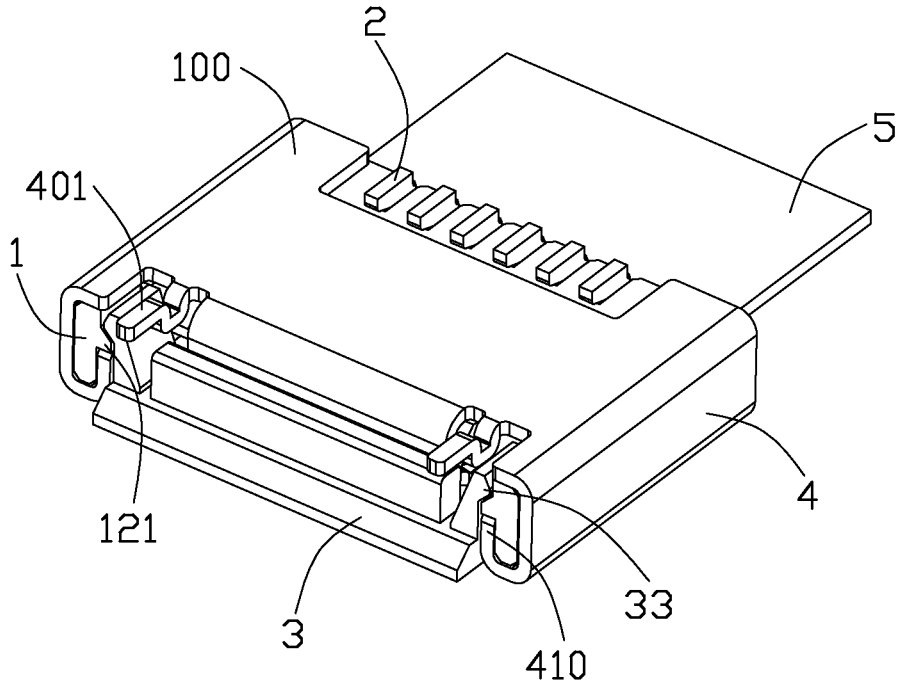
FIG. 2 is similar to FIG. 1 but from a bottom view.
Figure 3:
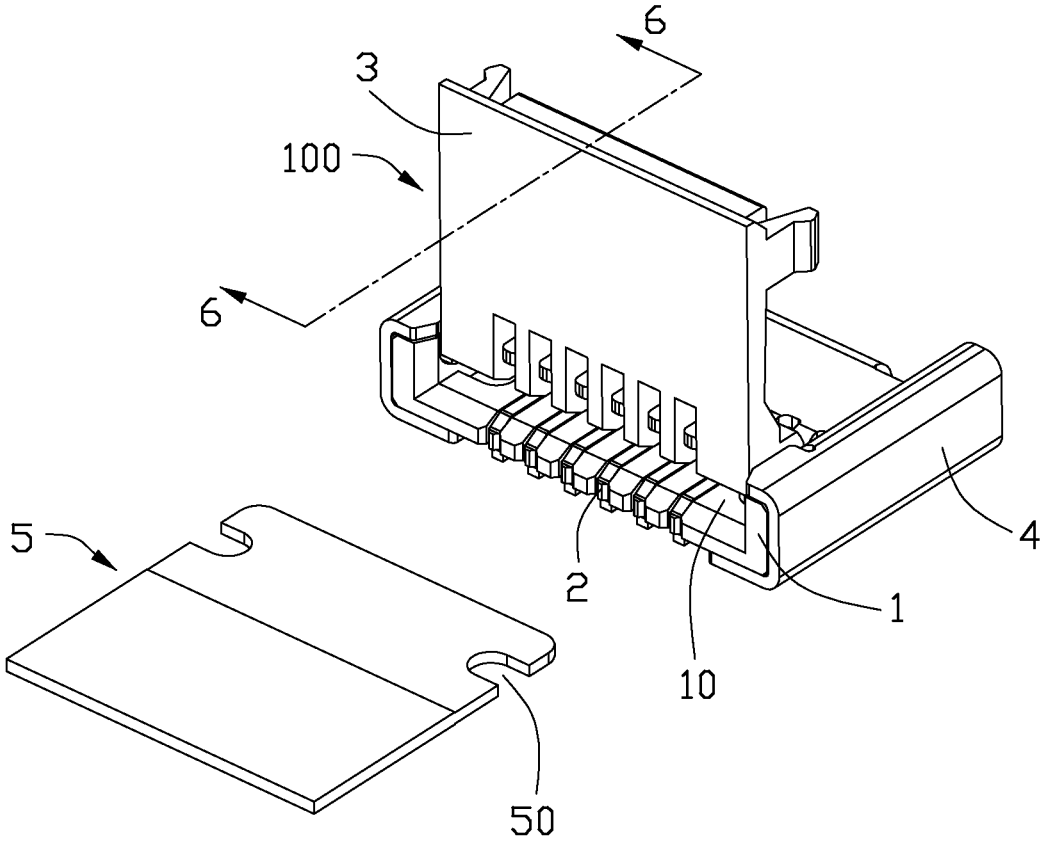
FIG. 3 is a perspective view of the electrical connector in a opening position.

Referring to FIGS. 1-3, description will be made as an electrical connector 100 according to an embodiment of the present invention, such as a flexible printed circuit or cable (FPC) connector, a flexible flat cable (FFC) connector, and so forth. The electrical connector 100 defines an inserting slot 10 which is intended to be inserted with a flat circuit 5 and comprise an actuator 3 movably mounted on connector 100 for movement between an open position allowing insertion of the flat circuit 5 into the inserting slot 10 as best shown in FIG. 3 and a closed position ensuring the flat circuit to stably touch with corresponding terminals 2 was best shown in FIG. 1.

Figure 4:
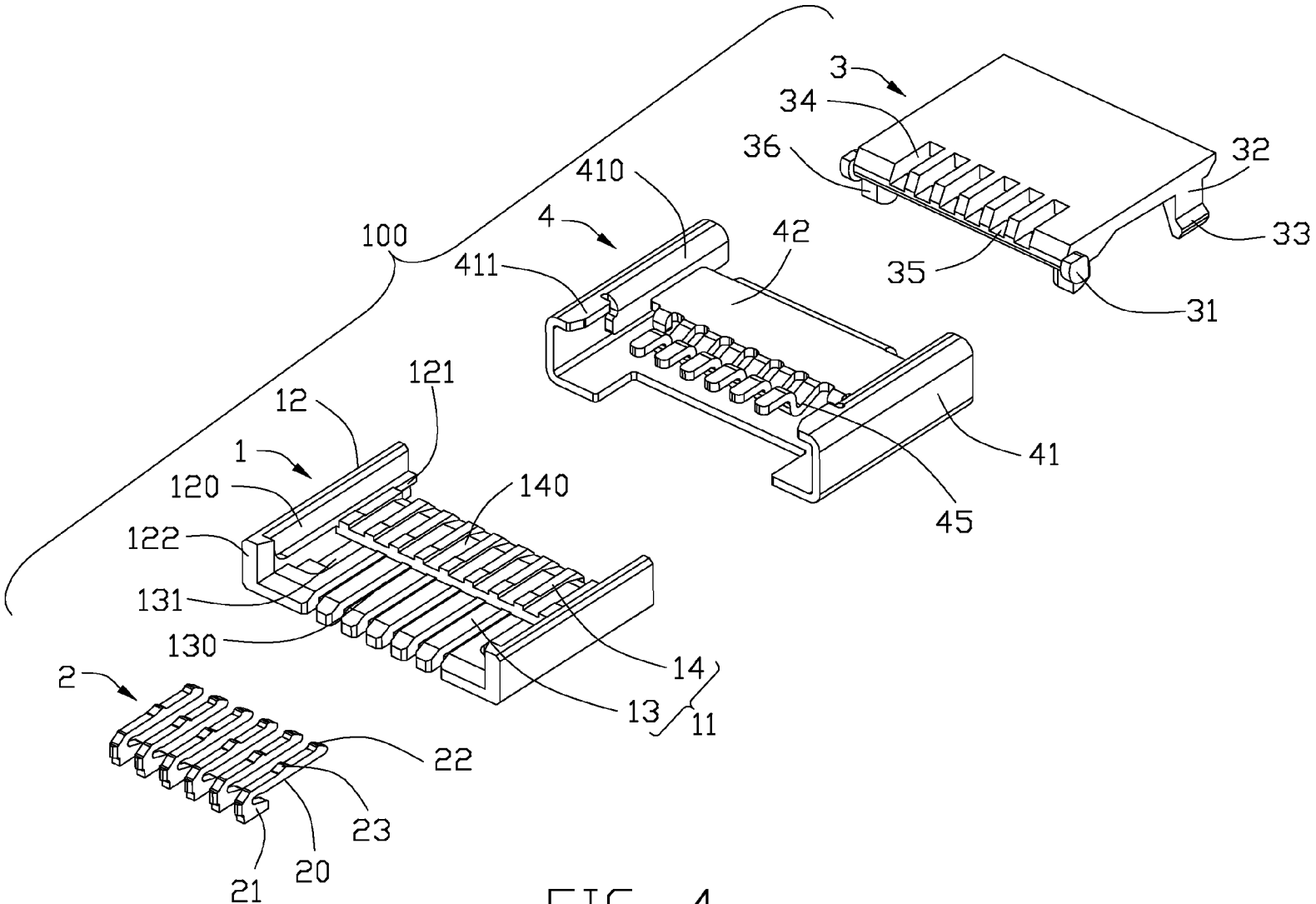
FIG. 4 is a perspective exploded view of the electrical connector.
Figure 5:
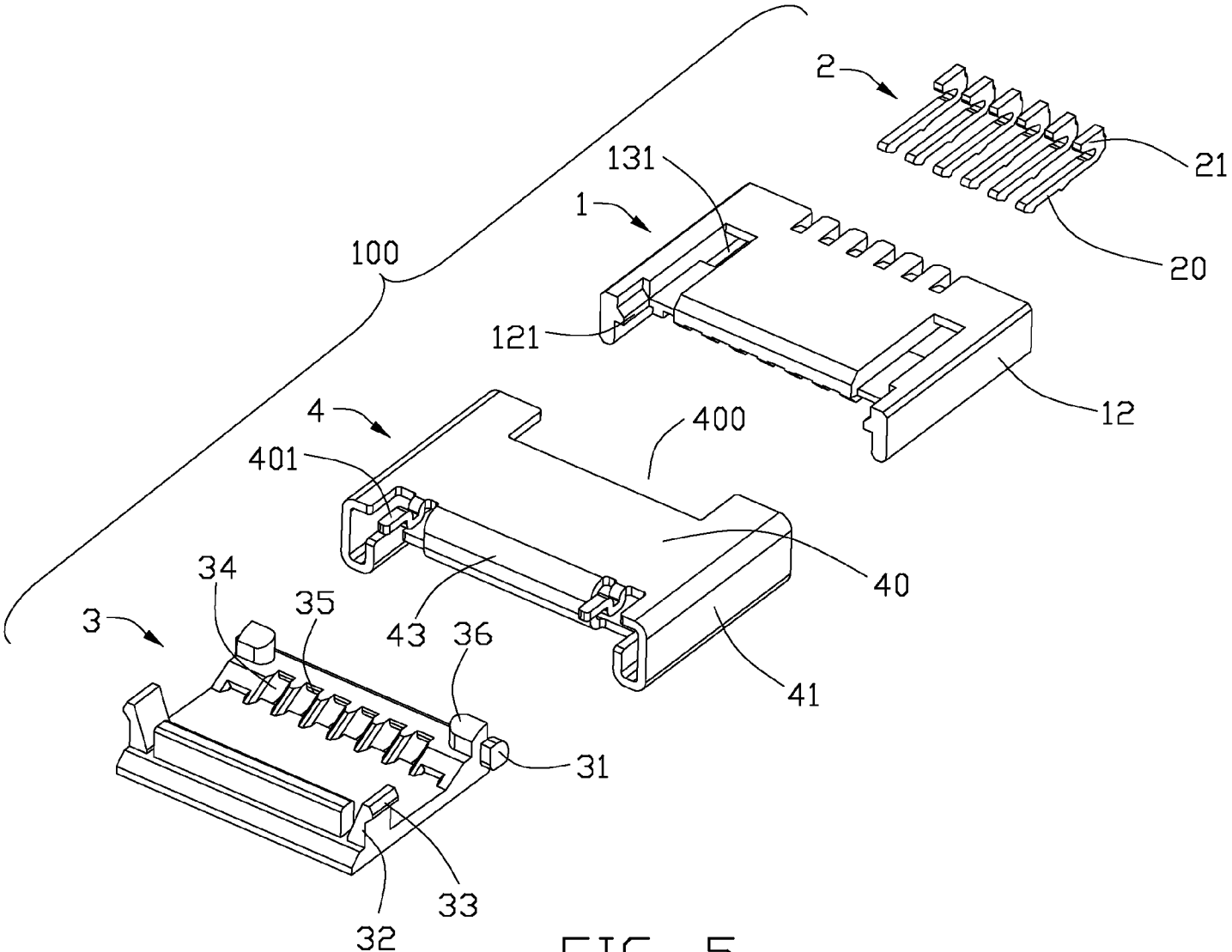
FIG. 5 is similar to FIG. 4 but from bottom view.

Referring to FIGS. 4 and 5, the electrical connector 100 comprises an insulative housing 1 with a bottom wall 11 and two side walls 12 extending upwards, thereby commonly defining an opening-upward space (not labeled). The bottom wall 11 is construed with a front lower portion 13 and a rear portion 14, the front lower portion 13 is adapted to define said inserting slot 10 to receive the flat circuit 5. The front lower portion 13 defines a plurality of spaced away passageways 130 arranged in a first direction oriented between said two side walls 12, which receive and retain corresponding conductive terminals 2. Combination with FIG. 7, the terminals comprise horizontal contacting beams 22 retained in the passageways 130 with a hook distal free end 22 retained in the rear portion 14. The contacting beams 22 define contacting projections 23 projecting in the inserting slot 10. Solder portions 21 bend downward to a bottom surface of the bottom wall 11 from the contacting beams 22 through a front opening of the inserting slot 10. The rear portion 14 defines a plurality of recesses 140 aligned with the passageways 130.

Each side wall 12 of the housing 1 defines an opening cavity 120 with a front tailgate 122. The actuator 3 defines a pair of pivot shafts 31 at two opposite ends in the front thereof and the pair of pivot shafts 31 forwardly slides into the opening cavity 120 until block by the front tailgates 122. The actuator 3 defines a comb portion (not labeled) between said pivot shafts. The comb portion defines a plurality of spaced away grooves 34 running through opposite surfaces thereof and a plurality of cam portions 35 located in the grooves 34.

A pair of positioning bosses 36 is defined at the inner surfaces adjacent to the pivot shafts 31 and a pair of lock portion 32 with an outward hook 33 disposed at the inner surfaces adjacent to a rear edge opposite to the positioning bosses 36.

A shielding shell 4 is surrounding the housing 1, which includes a bottom wall 40 and a pair of side walls 41 covering on the corresponding walls of the housing 1. The shell 4 is forward-slide assembled to the housing when the actuator 3 is in the opening cavity 120. The bottom wall 40 is equipped with a pair of solder sections 401 for surface mounting to a printed circuit board (not shown). The sidewalls 41 have inwardly-bending inner retain walls 410 sliding and retained in the cavities 120, thereby the outer side walls 41 and the inside retain walls being fitly clipped on the side walls 12 of the housing. The side walls 41 of the shell further define stop tabs 411 bending inward from a front top edge thereof, which prevents the actuator 3 from upwardly breaking off the opening cavity 120. The front tailgates 122 and the retained walls 410 limit the actuator 3 in the front-to-rear direction such that the pivot shafts 31 is rotated in the housing and limited by the shell. The shell 4 further defines a top wall 42 unitarily connecting to the bottom wall 40 by an inverted U shaped connecting portion 43. A plurality of spring fingers 45 unitarily extending from a front edge of the top wall 42, space away from each other in the first direction and inserted into the grooves 34 of the actuator 3. When assembly, the spring fingers slide forwardly along the recesses 140 and arrive above the front lower portion 13 of the insulating housing.

Figure 6:
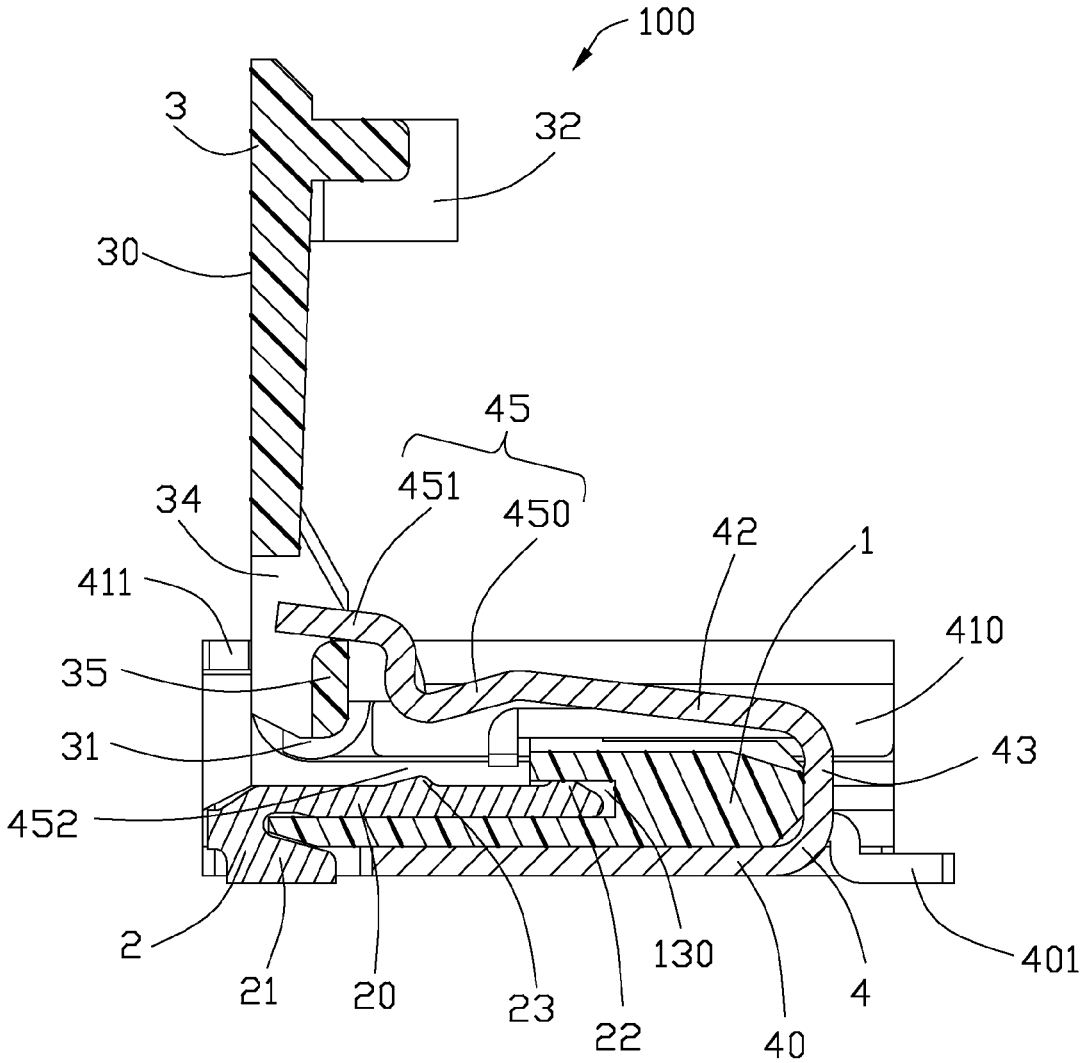
FIG. 6 is a cross-sectional view of the electrical connector along lines 6-6 in FIG. 3, wherein the actuator is in the opening position.
Figure 7:
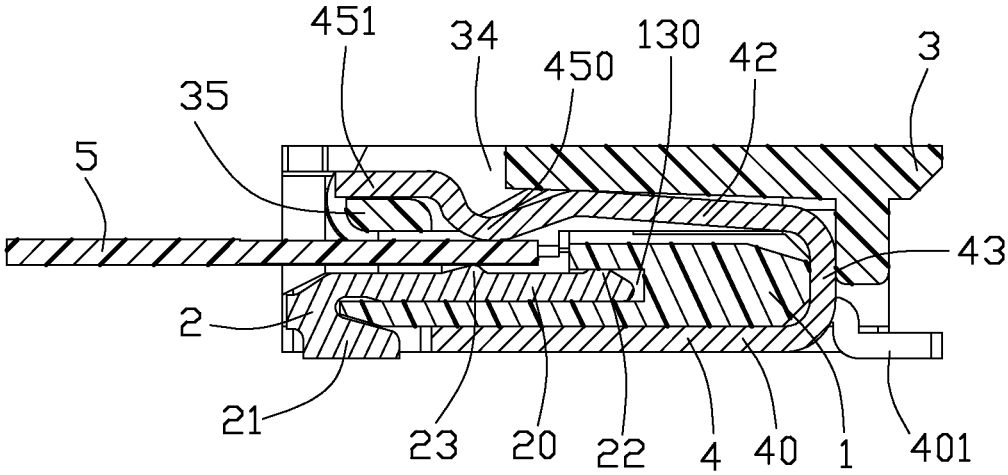
FIG. 7 is a cross-sectional view of the electrical connector along lines 7-7 in FIG. 4, wherein the actuator is in the close position.

FIG. 6 shows the opening position of the connector, the actuator 3 rotate forward and upwardly and the cam portion 35 stand upward to lift the spring finger 45. The fingers 45 bend downwards and then upward to form a horizontal portion, so that each finger 45 has a pressing beam 450 opposite to the contacting projection 23 and a pivot beam 451 at the horizontal portion from the pressing beam. The pivot beams are inserted into the grooves 34 of the actuator 3 and are supported by the cam portions 35. The longer axis of the cam portions 35 lifts the pivot beams 451 to enlarger a receiving path 452 between the contacting projections 23 and the pressing beams 450 in the opening position. Therefore, the flat circuit 5 can be inserted in the inserting slot 10 in a ZIF statue. After insertion of the flat circuit 5 as best shown in FIG. 7, the actuator 3 rotate downwards, the long axis of the cam portions 35 lie down and the spring fingers 45 restore, the pressing beams 450 press against a top surface of the flat circuit and the contacting projections 23 press against a bottom surface of the flat circuit board 5, so that a stable electrical connection of the terminals 2 and the flat circuit 5 is established. Alternately, the actuator 3 may downwardly press the top wall 42 to force the pressing beams to downwardly move and extending into the inserting slot 10. The lock portions 32 are retained in lock blocks 121 defined on the housing 1 labeled in FIG. 2, the positioning bosses 36 are inserted in the holes 131 defined on the bottom wall 11 of the housing as shown in FIG. 4 through corresponding notches 50 defined on flat circuit 5. Perfectly, the top surface of the flat circuit 5 is disposed with grounding traces, the pressing beams 450 touch with the grounding traces, which will improves insertion loss and return loss of the connector.

However, the disclosure is illustrative only, changes may be made in detail, especially in matter of shape, size, and arrangement of parts within the principles of the invention.

What is claimed is:

1. An electrical connector for connecting with a flat circuit, comprising:

an insulating housing defining an insertion slot for receiving the flat circuit;

a plurality of terminals arranged in the housing in parallel relationship, the terminals having contacting projections extending into the insertion slot;

a shielding shell surrounding the insulating housing, the shell having a plurality of spaced spring fingers extending into the inserting slot and establishing a receiving path between the contacting projections and the spring fingers for the flat circuit;

an actuator mounted on the electrical connector for movement between an open position lifting up the spring fingers of the shielding shell and allowing insertion of the flat circuit into the inserting slot and a closed position allowing the spring fingers restore and pressing against the flat circuit toward the contacting projections of the terminals;

wherein the spring fingers comprises press beams projecting downwards and opposite to the contacting projections and pivot beams unitarily extending from the pressing beams; the actuator defines a plurality of cam portions interposed with the pivot beams;

wherein the spring fingers extend forwardly and are located between the housing and the actuator; and wherein the pivot beam extend horizontally and are located in front of the contacting projection; the actuator defines a plurality of grooves receiving said pivot beams and said cam portions are located in the grooves to support the pivot beams.

2. The electrical connector as described in claim 1, wherein the terminals comprise horizontal contacting beams extending in the inserting slot, said contacting projections are located on the horizontal contacting beams.

3. The electrical connector as described in claim 2, wherein the terminals define solder portions extending from front ends of the horizontal contacting beams, rear ends of the horizontal portions retained in the housing.

4. The electrical connector as described in claim 1, wherein the insulating housing comprises a bottom wall and a pair of sidewalls to common define said inserting slot, the shell comprises a bottom wall and a pair of side walls corresponding covering on the walls of the insulating housing, the shell further comprises a top wall covering on the inserting slot and said spring fingers extend from the top wall of the shielding shell.

5. The electrical connector as described in claim 4, wherein the side walls of the shielding shell have inner retained walls on the side walls of the insulating housing.

6. The electrical connector as described in claim 5, wherein the insulating housing defines a front tailgate on each sidewall thereof and the shielding shell defines a top stop tab adjacent to the front tailgate to limit rotation of the actuator.

7. An electrical connector for connection with a flat circuit, comprising:

an insulative housing defining an inserting slot opening forward for receiving the flat circuit and arranged with a plurality of terminals with contacting beams located on one side of the inserting slot;

an actuator provided with cam portions and located on the insulating housing and rotating between a non-horizontal position for insertion of the flat circuit and a horizontal position allowing cam portions to press against the circuit board toward the contacting beams; and a shielding shell surrounding the insulative housing comprising a top wall located between the insulating housing and the actuator, a plurality of spaced spring fingers extending from the top wall and interposed with the cam portions;

wherein the actuator rotates adjacent to a front opening of the inserting slot and locks adjacent to a rear portion of the insulating housing;

wherein the actuator defines a plurality of grooves at a front portion of the actuator and said cam portions are located in grooves one by one, said spring fingers are received in the grooves and supported by the cam portions.

8. The electrical connector as claimed in claim 7, wherein the spring fingers touch with corresponding grounding traces defined on the flat circuit.

9. An electrical connector for use with a flexible printed circuit, comprising:

an insulative housing defining a receiving slot to communicate with an exterior via a front opening for receiving a flexible printed circuit;

a plurality of terminals disposed in the housing with contacting sections extending into the receiving slot;

resilient conductive fingers, each assembled to the housing and including a front pivot beam and a rear pressing beam; and an actuator movable relative to the housing with a pivot positioned at one end around the front opening and a cam portion around the pivot;

wherein when the actuator is moved to an open position, the cam portion upwardly presses the pivot beam to deflect the finger upward for having the pressing beam leave the receiving slot for allow the flexible printed circuit to be inserted thereinto via the front opening; when the actuator is moved to a locked position, the cam portion no longer upwardly presses the pivot beam but instead the actuator downwardly presses the finger to have the pressing beam enter the receiving slot to downwardly press and contact the flexible printed circuit under condition that the flexible printed circuit downwardly presses the contacting sections;

wherein said finger is a part of a shielding shell which encloses the housing;

wherein the shell defines a solder section corresponding to solder portions of the terminals;

wherein said actuator defines a plurality of grooves to receive the corresponding fingers, respectively.

10. The electrical connector as claimed in claim 9, wherein said actuator is pivotally assembled to the housing.

11. The electrical connector as claimed in claim 10, wherein said actuator defines a hook around the other and opposite to the pivot.

* * * * *